US008403600B2

(12) United States Patent
Weaver et al.

(10) Patent No.: US 8,403,600 B2
(45) **Date of Patent: *Mar. 26, 2013**

(54) DRILLING TOOL, A SELF-DRILLING ROCK BOLT, A DRILL BIT, AN ANCHORING DEVICE FOR A SELF-DRILLING ROCK BOLT, A SHAFT FOR A DRILLING TOOL AND AN END COUPLING FOR A DRILLING TOOL

(75) Inventors: Steven Weaver, Fletcher (AU); Darren Webb, Floraville (AU); John Horsch, Wallsend (AU); Matthew Kenny, Hamilton (AU)

(73) Assignee: Sandvik Intellectual Property AB, Sandviken (SE)

( * ) Notice: Subject to any disclaimer, the term of this patent is extended or adjusted under 35 U.S.C. 154(b) by 641 days.

This patent is subject to a terminal disclaimer.

(21) Appl. No.: 12/445,377

(22) PCT Filed: Oct. 26, 2007

(86) PCT No.: PCT/SE2007/000938

§ 371 (c)(1),
(2), (4) Date: Aug. 3, 2009

(87) PCT Pub. No.: WO2008/060212

PCT Pub. Date: May 22, 2008

(65) Prior Publication Data

US 2010/0098500 A1 Apr. 22, 2010

(30) Foreign Application Priority Data

Nov. 15, 2006 (AU) ..... 2006236010
Nov. 15, 2006 (AU) ..... 2006236012

(51) Int. Cl.
*E21D 21/00* (2006.01)

(52) U.S. Cl. ..... 405/259.1; 405/259.4; 411/29; 175/320

(58) Field of Classification Search .... 405/259.1–259.6; 166/243; 175/320; 411/132, 134, 141, 144, 411/145, 29

See application file for complete search history.

(56) References Cited

U.S. PATENT DOCUMENTS

| | | | | |
|---|---|---|---|---|
| 3,247,754 | A * | 4/1966 | Bieser | 411/29 |
| 4,034,788 | A * | 7/1977 | Melone | 411/134 |
| 4,717,183 | A | 1/1988 | Nobileau | |
| 4,793,754 | A | 12/1988 | Nobileau | |
| 4,902,047 | A | 2/1990 | Marietta et al. | |
| 5,275,512 | A * | 1/1994 | Wright | 405/259.6 |

(Continued)

FOREIGN PATENT DOCUMENTS

| | | |
|---|---|---|
| AU | 2006202778 | 1/2008 |
| EP | 0 099 293 | 1/1984 |
| WO | WO 2004/067902 | 8/2004 |
| WO | WO 2008/000015 | 1/2008 |

(Continued)

*Primary Examiner* — Sean Andrish

(74) *Attorney, Agent, or Firm* — Morgan, Lewis & Bockius LLP

(57) ABSTRACT

A drilling tool incorporating first and second ends, a shaft extending between the ends. The first end has a drill bit to penetrate rock. The drill bit and the shaft have complementary threads. The drill bit and the shaft comprise a relative rotation stop means that ensures that the drill bit remains loose during drilling in a first direction. The invention further relates to a self drilling rock bolt, a drill bit, drill shaft and shaft coupling, an anchoring device, and an end coupling per se.

23 Claims, 7 Drawing Sheets

U.S. PATENT DOCUMENTS

| | | | | |
|---|---|---|---|---|
| 6,263,988 | B1 * | 7/2001 | Matatof | 175/320 |
| 2001/0018990 | A1 | 9/2001 | Asberg et al. | |
| 2008/0038068 | A1 * | 2/2008 | Craig | 405/259.3 |

FOREIGN PATENT DOCUMENTS

| | | |
|---|---|---|
| WO | WO 2008/060211 | 5/2008 |

* cited by examiner

DRILLING TOOL, A SELF-DRILLING ROCK BOLT, A DRILL BIT, AN ANCHORING DEVICE FOR A SELF-DRILLING ROCK BOLT, A SHAFT FOR A DRILLING TOOL AND AN END COUPLING FOR A DRILLING TOOL

CROSS REFERENCE TO RELATED APPLICATIONS

This application is a National Stage Application of International Application No. PCT/SE2007/000938 filed Oct. 26, 2007, and claims benefit of Australian Application No. 2006236012 filed Nov. 15, 2006.

TECHNICAL FIELD

The present invention relates to drilling tools and rock bolts suitable for use in the mining and tunnelling industry to provide roof and wall support. The invention is suitable for use in hard rock applications as well as in softer strata, such as that often found in coal mines, and it is to be appreciated that the term "rock" as used in the specification is to be given a broad meaning to cover both these applications. The invention further relates to a drill bit, drill shaft and associated coupling, and an anchoring device per se.

BACKGROUND

Roof and wall support is vital in mining and tunnelling operations. Mine and tunnel walls and roofs consist of rock strata, which must be reinforced to prevent the possibility of collapse. Rock bolts are widely used for consolidating the rock strata.

In conventional strata support systems, a hole is drilled into the rock by a drill rod, which is then removed and a rock bolt is then installed in the drilled hole and secured in place typically using a resin or cement based grout.

To improve this process, self drilling rock bolts have been proposed whereby the bolt is also used as the drill rod. As such, with a self drilling rock bolt, the hole can be drilled and the bolt installed in a single pass.

Whilst self drilling rock bolts provide the opportunity to substantially improve installation times of rock bolts, they have not been widely used.

SUMMARY OF THE INVENTION

In accordance with a first aspect of the present invention, a drilling tool is provided that comprises first and second ends, a shaft extending between the ends, the first end having a drill bit to penetrate rock, the drill bit and the shaft having complementary threads, and a stop that limits rotation of the drill bit on the shaft to maintain the drill bit in loose threaded connection with the shaft during drilling in a first direction.

In one form, the stop limits the drill bit from rotating on the shaft so as to maintain a space between an end surface of the shaft and an end surface of the drill bit during drilling. In this way, the stop prevents binding of the drill bit onto the end of the shaft that could otherwise occur during drilling.

In a particular form, the stop comprises co-operating abutment surfaces, one surface disposed on the drill bit and the other surface disposed on the shaft. In one form, one of the drill bit and the shaft is provided with a projection and the other with a recess, the projection and the recess having respective ones of the abutment surfaces that provide the stop.

In one form, the shaft is formed as a unitary structure, typically made from steel. In another form, the shaft is made from multiple components. In a particular form, the shaft includes a main portion and an end portion. The main and end portions are interconnected by an appropriate coupling (such as a threaded coupling) with the end portion including a distal end incorporating the threaded coupling to receive the drill bit and one of the co-operating abutment surfaces of the stop.

In one form, the main portion is a conventional drill rod, and the end portion is provided as a coupling to allow for retro-fitting of the drill rod to include the stop. In a particular form, the coupling is arranged to screw into the existing threaded coupling provided on the end of the drill rod which traditionally has been provided to accommodate the drill bit. In this way no modification is required to the drill rod to allow the drilling tool to include the stop.

In accordance with another aspect of the invention, there is provided a self drilling rock bolt comprising first and second ends, a shaft extending between the ends, and an anchoring device extending along a first part of the shaft adjacent the first end, the anchoring device having an internal thread that cooperates with an external thread on the shaft, the first end having a drill bit to penetrate rock during drilling in a first direction and a stop to limit the rotation of the anchoring device on the shaft to maintain the anchoring device in loose threaded connection on the shaft during drilling.

In a particular form, the stop limits the anchoring device from rotating on the shaft so as to maintain a space between an end surface of the anchoring device and an end surface of the drill bit during drilling. In a particular form the stop comprises co-operating abutment surfaces, one surface disposed on the drill bit and the other surface disposed on the anchoring device.

In one form, the second end is adapted to be connected to a drilling apparatus to allow rotation of, and thrust to, the bolt, and the anchoring device comprising a mandrel, the mandrel being mounted to and cooperating with the external thread on the shaft and at least one expansion element overlaying the mandrel, wherein the at least one expansion element is operative to be displaced radially outwardly on rotation of the mandrel on the shaft in a direction that causes movement of the mandrel relative to the expansion element towards the second end, the rotation of the mandrel being arranged to occur on rotation of the shaft in a second direction opposite to said first direction.

An advantage of the stop according to this aspect of the invention when used in conjunction with an anchoring device of the above form is that the stop will inhibit jamming of the anchoring device with the drill bit which could otherwise occur during drilling when the shaft is rotating in the first direction. If the anchoring device did jam then activation of the anchoring assembly may not occur when the shaft is rotated in the opposite direction as the mandrel is required to rotate freely on the external thread of the shaft during this activation.

In one form, one of the cooperating abutment surfaces of the stop is provided directly on mandrel.

In an alternative arrangement, the at least one expansion element is joined to a connector forming an anchor assembly that is arranged to be captured between the end surface of the drill bit and the end surface of the shaft. In this arrangement, one of the cooperating abutment surfaces of the stop is provided on the connector. In this form the stop is arranged to adopt a disengaged condition when the connector is disposed on the shaft end so that the stop does not prevent rotation of the anchoring device on the shaft and an engaged condition where the connector is spaced from the shaft end. In this engaged condition the stop is active to prevent the anchor assembly from rotating about the shaft thereby preventing the mandrel from moving axially towards the drill bit during drilling.

In one form, the stop is caused to move from the disengaged condition to the engaged condition on movement of the mandrel into a predetermined position. In this position, the mandrel typically projects above the shaft end and is moved into position under rotation of the mandrel about the shaft in the direction that induces axial movement of the mandrel towards the drill bit.

To ensure that the stop does not prevent activation of the anchoring device, the stop is caused to move from its engaged condition to the disengaged condition on movement of the mandrel from the predetermined position under the opposite rotation of the mandrel.

In one form one of the drill bit and the anchoring device is provided with a projection and the other with a recessed surface, the projection and the recessed surface having respective ones of the abutment surfaces that provide the stop. In one form, the recessed surface is inclined at an acute angle relative to a shoulder surface of the drill bit or anchoring device in which that surface is formed. In one form the recessed surface houses the projection at least during drilling. In a particular form, the recessed surface connects to at least one upstanding wall that forms one of the cooperating abutment surfaces and wherein the projection comprises a leading edge that forms the other abutment surface of the stop bit.

In one form, the recessed surface is inclined at an acute angle relative to the shoulder surface.

In one form, the magnitude of the angle is at least 20% greater than a pitch angle of an external thread formed on the shaft.

In a particular form, the projection has a maximum height that is less than the largest depth of the recessed surface.

In accordance with another aspect of the present invention, there is provided a drill bit for a drilling tool comprising a bit body which includes means for cutting rock at one end and a drill bit shank which incorporates a thread, wherein the drill bit is provided with a shoulder surface in connection with the drill bit shank, wherein the shoulder surface forms part of a stop.

In one form, the stop comprises a recessed surface on the shoulder surface of the drill bit. In a particular form of this arrangement, the recessed surface connects to at least one upstanding wall.

In a particular form, the recessed surface is inclined at an acute angle relative to the shoulder surface.

In one embodiment, the magnitude of the angle is greater than a pitch angle of an external thread formed on the drill shank.

In accordance with still another aspect of the present invention, there is provided an anchoring device for a self drilling rock bolt for retaining the bolt when located in a drilled hole comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, the anchor assembly being keyed to the mandrel, and the anchor assembly comprising part of a stop.

In a particular form, the stop is provided to stop the anchor assembly from rotating about an axis and prevent the mandrel from moving axially in one direction along a bolt shaft during drilling in a first direction.

In one form, the stop comprises a projection provided on the connector. In a particular form, the projection comprises a leading edge.

In one alternative form, the connector includes a body section and at least one connecting leg, each said leg carrying a tag. In one form, the tag that is provided adjacent to an end of the leg and is integrated with the connector, the tag being adapted to be passive during drilling and active during anchoring of the anchoring device.

In accordance with yet a further aspect of the invention there is provided a shaft for a drilling tool, the shaft including opposite first and second ends, and wherein the first end incorporates a shoulder surface that projects from the first end and forms part of a stop.

In one form the first end further incorporates a threaded bore arranged to receive a drill bit having a shank with a complementary external thread. In a particular form, the shaft comprises a main portion and an end portion, the main and end portions being interconnected and axially aligned and the end portion incorporating the first end of the shaft.

In yet a further aspect, the present invention provides an end coupling for a drill rod, the end coupling having opposite first and second ends, a threaded shank formed along an end portion of the coupling and extending to the second end and wherein a shoulder surface projects from the first end and forms part of a stop.

BRIEF DESCRIPTION OF THE DRAWINGS

It is convenient to hereinafter describe embodiments of the present invention with reference to the accompanying drawings. The particularity of the drawings and the related description is to be understood as not superseding in generality of the preceding broad description of the invention.

In the drawings.

DETAILED DESCRIPTION OF THE DRAWINGS

Figure 1:
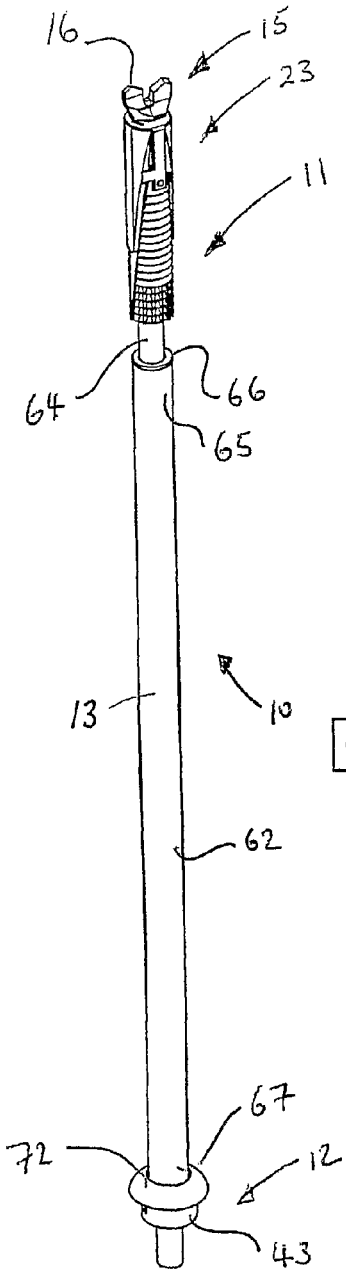
FIG. 1 is a schematic perspective view of a drilling tool.
Figure 6B:
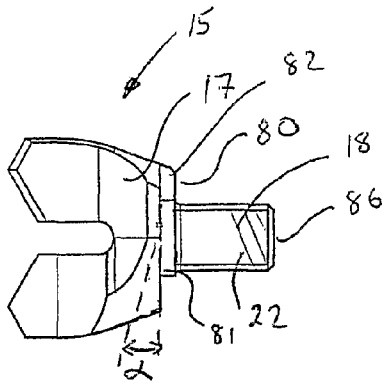
FIG. 6B is a side view of a drill bit of the drilling tool of FIG. 1.
Figure 6A:
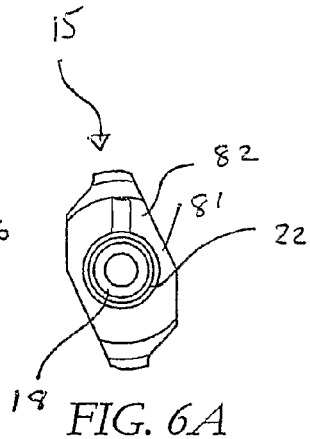
FIG. 6A is a bottom view of a drill bit of the drilling tool of FIG. 1.

FIG. 1 illustrates a self drilling rock bolt 10 which incorporates a first (drilling) end 11 and a second (nut) end 12 and a shaft 13 which extends between the opposite ends 11, 12. The shaft 13, which is typically made from steel, is solid along a major (second) part of its length and incorporates an inner passage 14 (see FIG. 4) along a distal (first) part of bolt adjacent the drilling end. The inner passage communicate with the exterior of the shaft at two places; though a lateral port 60, and through an end port 61.

In use, the self drilling rock bolt 10 is connected to a drilling and bolting apparatus (not shown) and acts as a drill rod to drill a hole 100 (see FIG. 4) into rock strata 500. Thereafter, the rock bolt 10 is secured in place as will be explained in more detail below to provide support for the rock strata 500.

The drilling end 11 incorporates a drill bit 15 incorporating a drill tip 16 at an end thereof and an anchoring device 23 which in use is arranged to retain the bolt in a drilled hole. The anchoring device 23 extends along the first part of the bolt and is used to retain the bolt 10 in the drilled hole so as to temporarily secure the rock bolt in place prior to the introduction of grout into the hole 100 to permanently fix the bolt in place and/or to tension the bolt so as to place the rock strata 500 in compression.

The details of the drilling end 11 are best seen in FIGS. 2A to 6B.

During a drilling operation, the drilling apparatus typically induces right hand rotation to the drill shaft. To ensure that the drill bit 15 does not separate from the shaft during the drilling operation, the threaded coupling between the drill bit 15 and the shaft 13 is a right handed thread so as to tend to cause the threaded coupling between the drill bit and shaft to tighten during a drilling operation.

Figure 4:
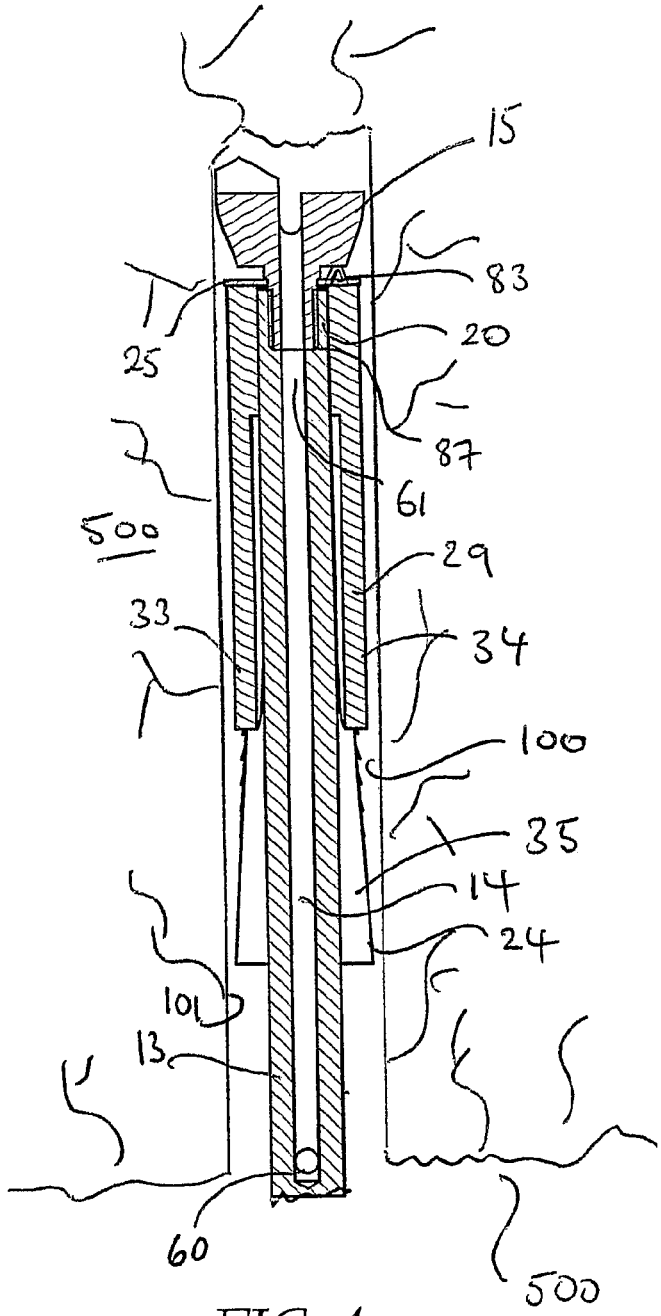
FIG. 4 is a sectional view of the first end of the drilling tool of FIG. 1 when located in rock strata.

The drill bit 15 includes a bit body 17 which includes the drill tip 16 at its outer end and a drill bit shank 18 which incorporates a fastening means such as an external thread 22 on its outer surface. A passage 19 extends from the distal tip of the shank 18 through to the distal end of the bit body 17. This passage 19 is arranged to be in fluid communication with end port 61 of the inner passage 14 of the shaft when the drill bit 15 is secured to the shaft end 20 (as best seen in FIG. 4). The shaft end 20 includes an inner thread 21 (see FIG. 4) which is complementary to the external thread 22 on the drill bit shank 18. As such, the drill bit 15 can be simply screwed on to shaft end 20 of the shaft 13.

The drill bit 15 is provided with a lower end surface 80 in connection with the drill bit shank 18. The lower end surface 80 extends substantially perpendicularly to the drill bit shank. The shoulder surface faces towards the shaft 13 when the drill bit has been mounted. The shoulder surface comprises at least one recessed surface 81 that incorporates an upstanding wall 82. The recessed surface 81 is in the illustrated form generally parallel to the lower end surface 80 but in another form may be inclined at an acute angle $\alpha$ (shown in FIG. 6B) relative to the lower end surface 80. The magnitude of the angle $\alpha$needs to be greater than a pitch angle of the external thread formed on the drill shank. The magnitude of the angle $\alpha$ is at least 20% greater than the pitch angle of an external thread 38 formed on the bolt shaft 13. Stated in another way, the recessed surface may incline similar to a left handed thread as opposed to the right handed thread 22 in FIG. 6B. The upstanding wall 82 is to form part of a stop discussed more in detail below.

The anchoring device 23 is disposed below the drill bit 15 and includes a pair of expansion elements 24 which are designed to be caused to move outwardly from a retracted position as illustrated in the drawings to an expanded condition (not shown) wherein the expansion elements 24 engage the wall 101 of the drilled hole 100.

The expansion elements 24 are interconnected by a connector or a bail strap 25. This connector is typically made from steel and includes a substantially circular body section 26 and connecting legs 27. The connecting legs 27 are riveted (or otherwise fixed) to a proximal end 28 of the expansion elements 24. The expansion elements are joined to the connector to form an anchor assembly. By making the connector 25 from steel, it can flex thereby providing a live hinge that allows pivoting of the expansion elements so as to enable them to easily move between their retracted and their extended position.

Figure 5B:
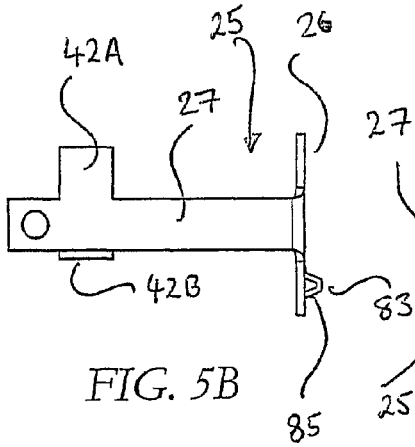
FIG. 5B is a side view of a connector of the drilling tool of FIG. 1 partly in a collapsed condition and partly in an expanded condition.

The body section 26 is preferably substantially circular and comprises a central hole 84 to receive the drill bit shank 18. The body section 26 is provided with at least one projection or upstanding tongue 83 at the surface facing towards the drill bit 15. The tongue 83 is preferably punched out of the body section at a mid-area location, i.e. at a location in between the hole 84 and a periphery of the body section. The tongue 83 has a general V-shape as best seen in FIG. 5B but may have any suitable shape such as a U-shape or semicircular. The tongue has a maximum height that is less than the largest depth of the recessed surface 81. The tongue comprises a leading edge 85, i.e. leading if the connector is rotated in the left hand direction. The leading edge 85 is substantially perpendicular to a plane of the body section 26. The tongue is to be received by the recessed surface 81 and can abut against the upstanding wall 82 during drilling. Thus, the tongue is to form part of the first relative rotation stop means discussed more in detail below.

Figure 5A:
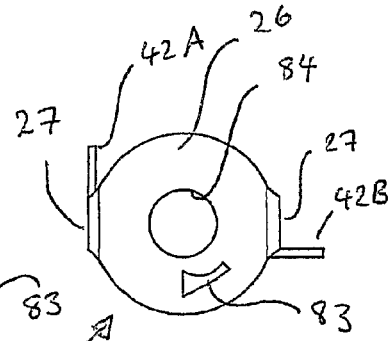
FIG. 5A is a top view of a connector of the drilling tool of FIG. 1 partly in a collapsed condition and partly in an expanded condition.
Figure 2A:
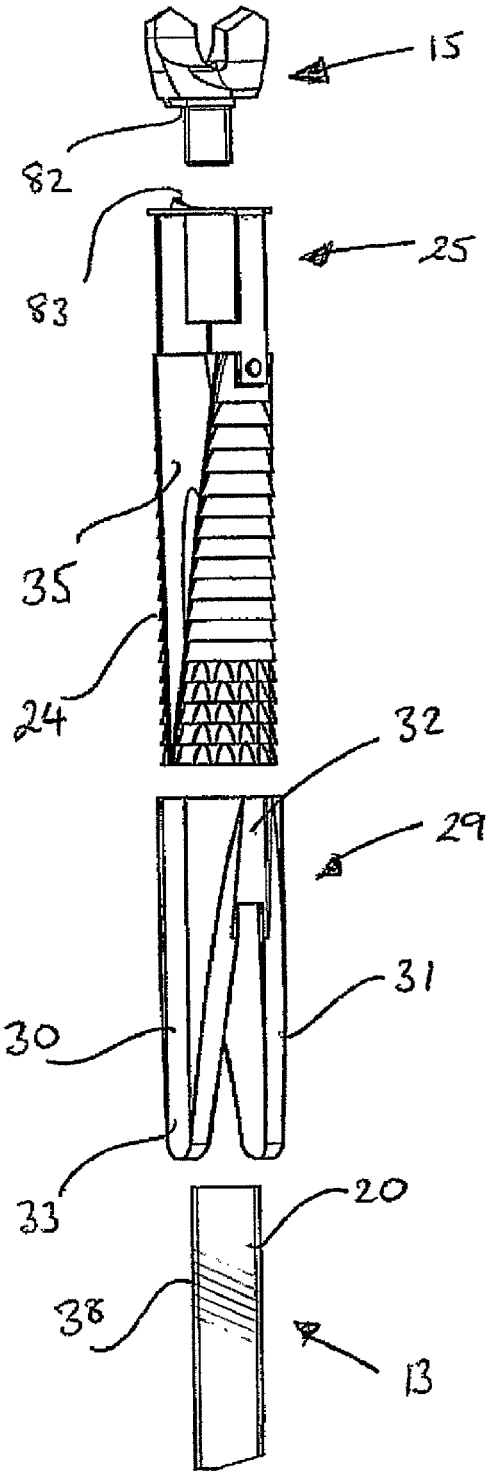
FIG. 2A is an exploded view of a first end of the drilling tool of FIG. 1.
Figure 2B:
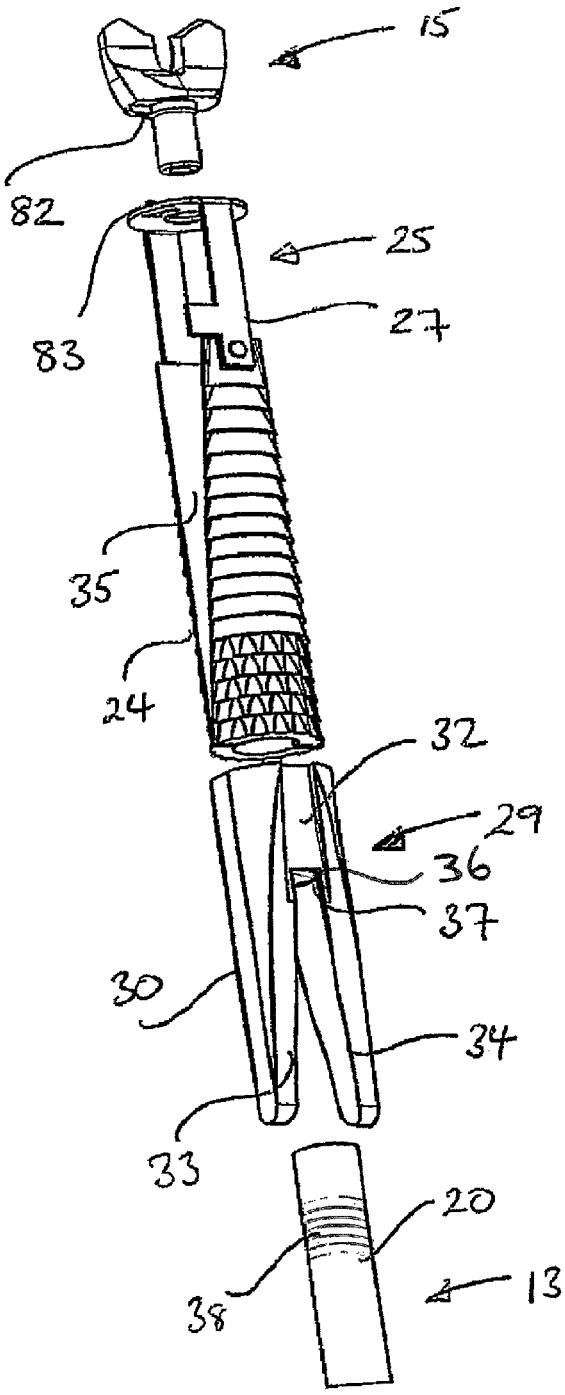
FIG. 2B is another exploded view of the first end of the drilling tool of FIG. 1.

If the anchoring device is prone to get stuck at the shaft end 20, each leg 27 may carry a second stop or leading tag 42A, 42B, i.e. 'leading' if the connector 25 is rotated in the left hand direction. The tag 42A, 42B is provided adjacent to an end of the leg distal from the body section 26 and is integrated with the connector. In FIGS. 5A and 5B the tag 42A is shown in a retracted position while the tag 42B is shown in an expanded position, for illustrative reasons. Thus, the tag is adapted to be passive during drilling (right hand rotation) but active during anchoring (left hand rotation). The geometries of the tags are optional.

The anchoring device 23 further includes a mandrel 29 which includes opposite inclined surfaces 30 and 31. In the illustrated form, the mandrel 29 includes a head portion 32 and two depending legs 33 and 34 with opposite faces of the head portion 32 and opposite edge surfaces of the legs 33 and 34 forming respective ones of the inclined surfaces 30 and 31. The head portion 32 may have two opposed grooves to house parts of the legs of the connector.

The mandrel is arranged so that the inclined surfaces 30 and 31 are generally flat and designed to abut with inner surfaces 35 of the expansion elements 24 in a manner such that relative movement of the mandrel towards the nut end 12 of the shaft causes the expansion elements to move from their retracted position to their extended position.

To enable this relative movement, the mandrel is coupled to the bolt shaft which in the illustrated arrangement is through a threaded coupling with an internal thread 36 formed in an inner bore 37 in the head portion 32 of the mandrel 29 and an external thread 38 formed on the bolt shaft 13.

The threaded coupling between the mandrel 29 and the bolt shaft 13 is a left handed thread so that when the rock bolt is undergoing a drilling operation (under right hand rotation of the shaft), any relative motion between the mandrel and the shaft would cause the mandrel to move towards the drill end thereby ensuring that the expansion elements are not moved to their expanded condition. However if there is too much movement, the mandrel would force the connector hard against drill bit so that the mandrel could not rotate under left hand rotation thereby preventing activation of the anchor as the mandrel could not wind down the shaft.

To prevent this occurring, the stop is provided by the cooperating abutment surfaces of the upstanding wall 82 and the tongue 83. This stop is active when these two surfaces move into engagement and limits the anchoring device from rotating on the shaft so as to maintain a space between an end surface of the anchoring device and an end surface of the drill bit during drilling.

Figure 7A:
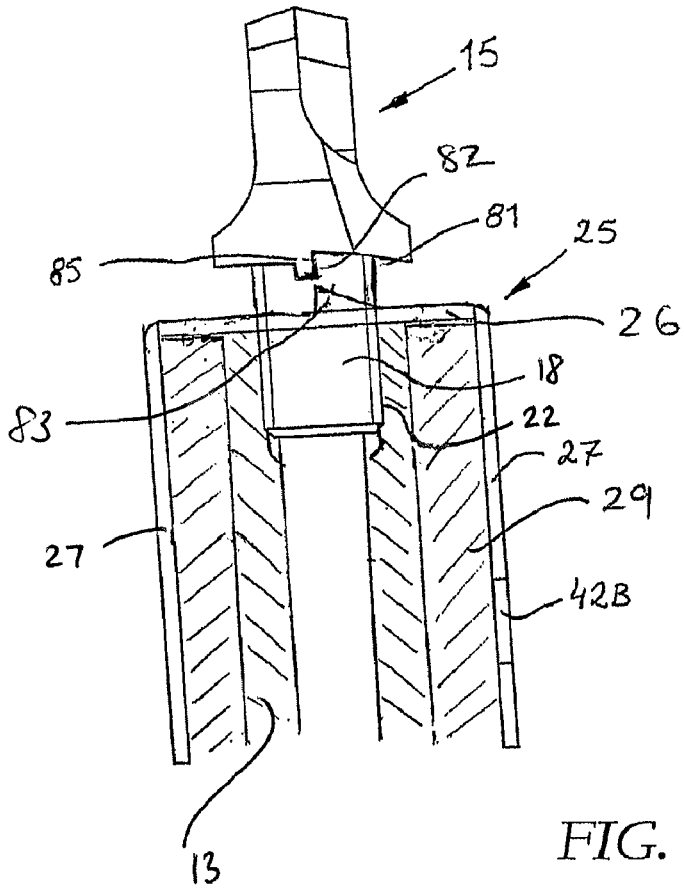
FIG. 7A is a side view of the drilling tool of FIG. 1 with the drill bit disengaged with the connector of FIGS. 5A and 5B.
Figure 7B:
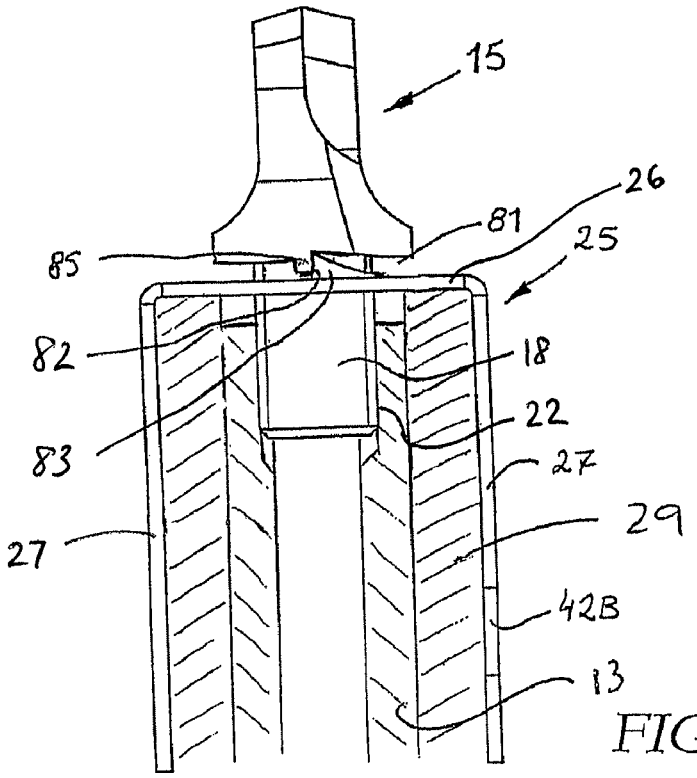
FIG. 7B is the drilling tool of FIG. 7A with the drill bit engaged with the connector.

The operation of the stop is best illustrated in FIGS. 7A and 7B. As best shown in FIG. 7A, a gap is provided between the lower end surface 80 of the drill bit 15 and the end of the shaft 13. This gap is large enough so that when the connector is resting on the shaft end the upstanding wall 82 and tongue 83 are disengaged. Therefore the stop is not active and does not prevent any rotation of the mandrel 29 on the shaft. However if the mandrel is caused to wind along the shaft in the direction of the drilling end 11, it will eventually lift the connector off the end of the shaft 13 thereby moving the tongue 83 into engagement with the upstanding wall 82 as shown in FIG. 7B. This causes the stop to become active and prevents further rotation of the mandrel in that direction. Also in that position the connector 25 is still spaced from the lower end surface 80 of the drill bit so that the mandrel remains loosely threaded on the shaft.

When the bolt 10 undergoes left hand rotation there is no impediment to the mandrel winding down the shaft as the two abutting surfaces of the stop do not prevent movement of the mandrel in that direction.

The anchoring device 23 may further comprise an annular band, not shown, which can be disposed around a distal end of the expansion elements 24. The annular band is typically made from a polymeric or rubber material and is provided to hold the expansion elements 24 together only during transport and start of drilling.

Figure 3:
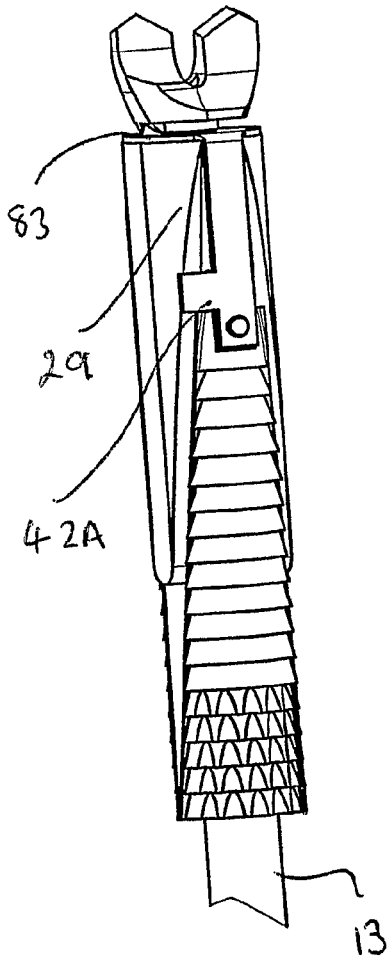
FIG. 3 is a side view of the first end of the drilling tool of FIG. 1.

The tags 42A, 42B of the connector are arranged to adopt two conditions. In the first condition as illustrated in FIG. 3, the tags 42A, 42B are folded towards the mandrel 29. This condition occurs when the tags undergo right hand rotation as would be the case during the drilling operation. In the second condition as best illustrated to the right in FIG. 5A, the tags project outwardly from the periphery of the connector 25. This occurs during the opposite rotation of the bolt and is induced by tags passing over the wall surface 101 of the drilled hole under this rotation. When in this second (or expanded) condition, there is a greater tendency for the tags to engage the wall surface of the drilled hole. Once they do grip, the anchoring device begins to slip relative to the shaft thereby inducing some relative movement. This movement, in turn causes the mandrel to start winding down the shaft thereby causing the expansion elements to be displaced outwardly.

Thus, the connector 25 performs several functions. The first function is to hold the expansion elements a set distance axially from the end of the shaft. The second function is to rotationally join the mandrel and the expansion elements together. The third function is to provide a hole so that the drill bit can be threaded into the shaft. The fourth function is to form part of a rotation stop that stops the mandrel from being screwed tightly against the drill bit. The fifth function is to provide tags that grip the bore wall during anchoring, thus allowing the anchoring device to rotate relative to the shaft.

Figure 9:
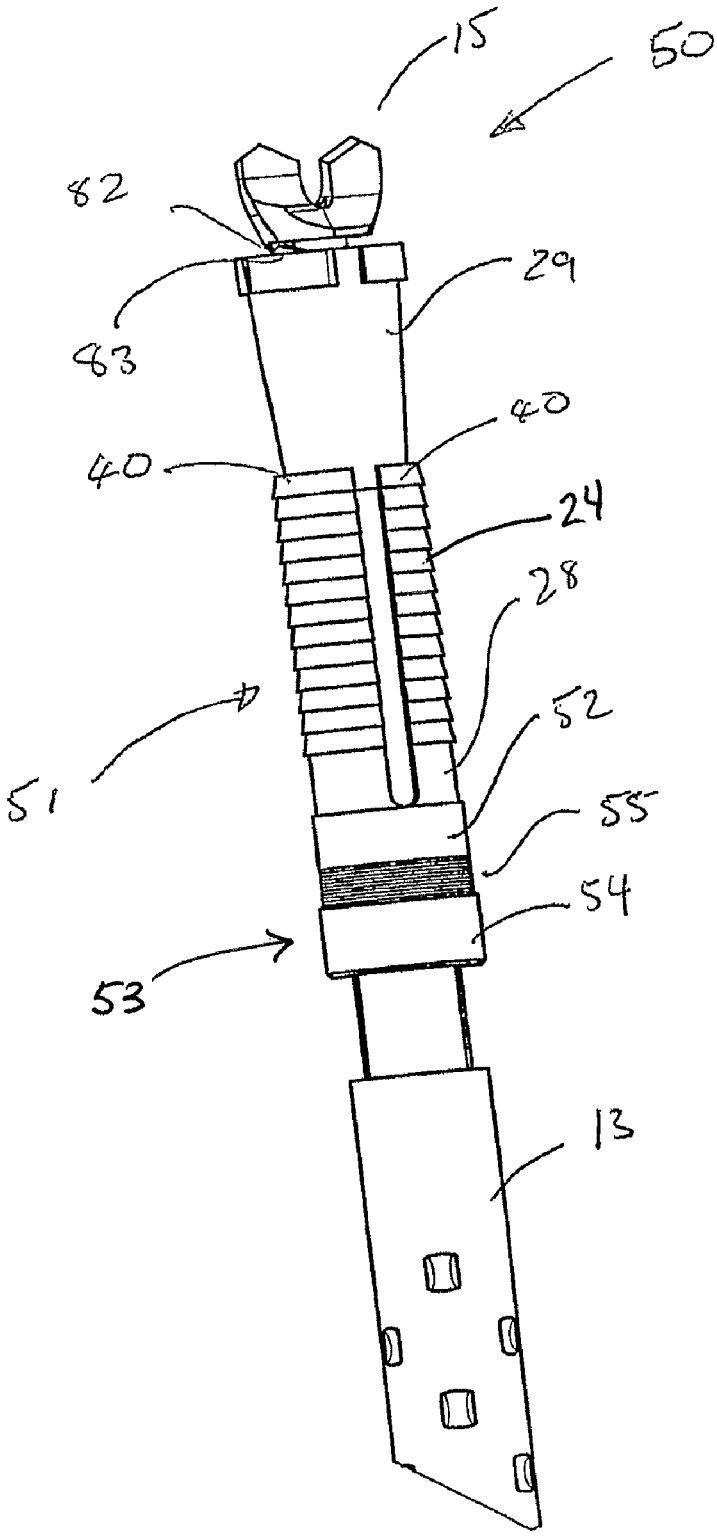
FIG. 9 is a schematic perspective view of a further alternative drilling tool.

A variation of the rock bolt 10 is illustrated in FIG. 9. The rock bolt 50 includes many of the features of the bolt 10 and like features have been given like reference numerals.

In the bolt 50, an expansion assembly 51 is provided that includes the expansion elements 24 and a collar 52 disposed about the shaft 13 of the bolt 50. The collar 52 functions in the same way as the connector 25 of the earlier embodiment and interconnects the proximal ends 28 of the expansion elements 24.

In contrast to the earlier embodiment, the expansion assembly 51 is orientated so that the distal ends 40 of the expansion elements face towards the drill end 11, rather than the nut end 12 as in the earlier embodiment. To prevent movement of the expansion assembly 51 towards the nut end 12, the assembly 51 is seated on a retaining device 53 that comprises a thrust ring 54 that is axially fixed to the bolt shaft 13 and a slip ring 55 disposed between the thrust ring 54 and the collar 52.

In an arrangement consistent with the earlier embodiment, the assembly 51 incorporates the mandrel 29 arranged so that its inclined surfaces 30 and 31 are designed to abut with inner surfaces 35 of the expansion elements 24. In this way relative rotation between the mandrel 29 and the expansion elements 24 about the shaft axis is inhibited. Further, relative movement of the mandrel 29 towards the nut end 12 of the shaft causes the expansion elements to move from their retracted position to their extended position. Furthermore, the mandrel is coupled to the bolt shaft by a threaded coupling (not shown). The threaded coupling between the mandrel 29 and the bolt shaft 13 is a left handed thread so that when the rock bolt is undergoing a drilling operation (under right hand rotation of the shaft), any relative motion between the mandrel and the shaft would cause the mandrel to move towards the drill end thereby ensuring that the expansion elements are not moved to their expanded condition. Under left hand rotation of the bolt 50 rotation of the expansion element is arranged to occur and whilst not shown, the anchor device 23 may also incorporate the band to promote this rotation. Because the mandrel portion 29 and the expansion assembly 51 rotate together, this rotation is translated to the mandrel 29, to activate the device 23 and cause movement of the mandrel towards the nut end 12.

In a similar manner to the earlier embodiment a stop is provided to prevent excessive movement of the mandrel towards the drill bit. However, in this embodiment the tongue 83 which forms one of the cooperating surfaces of the stop is formed directly on the mandrel 29.

As illustrated in FIG. 1, the rock bolt 10 includes a sleeve 62 along a major part of the shaft 13. The sleeve 62 extends from adjacent the anchoring device 23 through to and adjacent the nut end 12. The purpose of the sleeve is to provide at least part of a circulation path to allow fluid to be passed from the nut end 12 to the drilling end 11. This circulation path is provided by a passage formed between the bolt shaft 13 and the sleeve 62 as well as the inner passage 14. The inner passage 14 communicates with a passage formed between the shaft 13 and the sleeve 62 through the lateral port 60.

The circulation path also includes an outer passage 64 formed between the sleeve 62 and the wall 101 of the drilled hole 100. This outer passage is formed by having the drill tip 16 extend radially a distance greater than the radius of the sleeve 62.

The sleeve 62 is sealed at its distal end 65 by a collar 66. This collar 66 can incorporate an internal thread to be threaded onto the external thread 38 machined on the upper part of the shaft 13.

The proximal end 67 of the sleeve 62 is also sealed by inter engaging with a drive coupler 43 as described in detail in applicant's Australian patent application No. 2006202778, which is hereby incorporated into the present specification.

A bearer plate and ball washer 72 may be disposed on the shaft 13 and captured by the drive nut 43. The bearer plate is arranged to bear against the outer face of the rock strata 500.

Before operation, the anchoring device 23 is threaded onto the shaft 13 suitably until the shaft end 20 abuts against the lower side of the body section 26 of the connector 25. Then the drill bit 15 is threaded into the inner thread 21 of the shaft end until a drill bit shank end 86 engages a bottom 87 of the inner thread 21.

In operation, the bolt 10 is secured to a drilling apparatus, via the drive nut 43, which rotates the rock bolt in the first direction. Drilling fluid is pumped around the circulation passage formed by passage between the shaft and the sleeve 62, inner passage 60, and outer passage 64 to flush the rock cutting surface of the rock bolt. The fluid is either introduced or withdrawn from a port in the irrigated drive nut 43.

On completion of the drilling phase, the drilling apparatus then rotates the bolt in the opposite direction. The drive nut 43 rotates with the shaft 13 as relative movement is prevented by a torque pin. This causes the tags 42 (if present) to flare outwards causing the connector to grip the wall surface 101 causing the expansion elements 24 and mandrel 29 to start to slip relative to the bolt shaft. This relative movement induced between the anchoring device and the shaft causes the mandrel to wind down the thread of the shaft thereby causing the expansion elements to displace radially outwardly to engage the rock surface of the drilled hole.

When the expansion elements are engaged with the wall surface, the bolt is placed in tension by continuing to apply torque in the second direction to the drive nut 43. At a particular point, the expansion elements 24 are forced so hard against the rock wall surface that the mandrel cannot move down the shaft any further. This then effectively binds the bolt and inhibits it from rotating any further. This builds up the torque at the drive nut 43 until it reaches a point where it will shear a torque pin thereby letting the drive nut to move relative to the shaft. This relative movement then causes the nut to wind up the shaft.

Once the drive nut is able to move along the bolt shaft, it will then move into engagement the outer face of the rock strata 500 (either directly or through the bearer plate) which will then enable the bolt to be placed in tension as the effective length of the bolt between the drive nut and the anchoring device is shortened. Once the bolt is under sufficient tension, the drilling apparatus can then be removed and possibly for further support a final stage of setting the bolt in place by the introduction of the grout through a port in the drive nut 43 can take place.

Figure 8A:
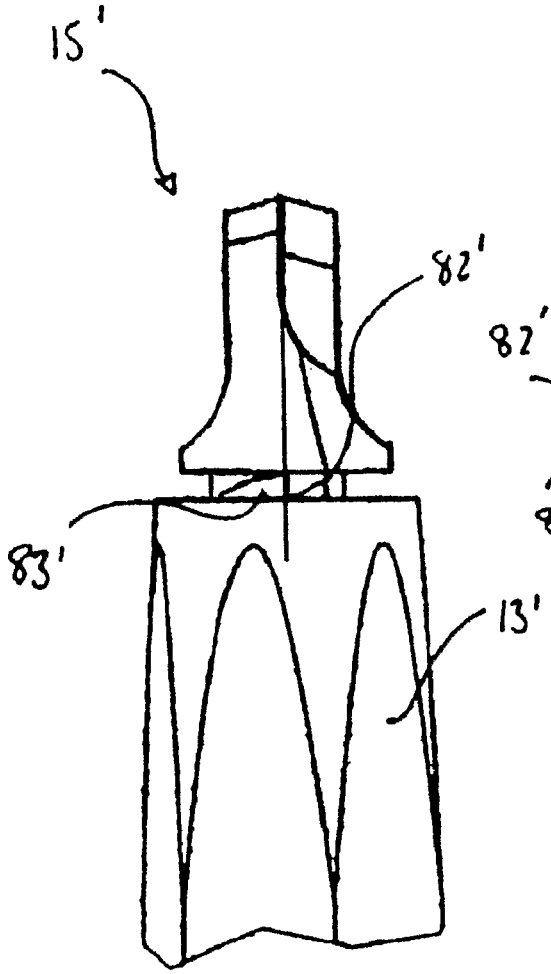
FIG. 8A is a side view of an alternative drilling tool.
Figure 8B:
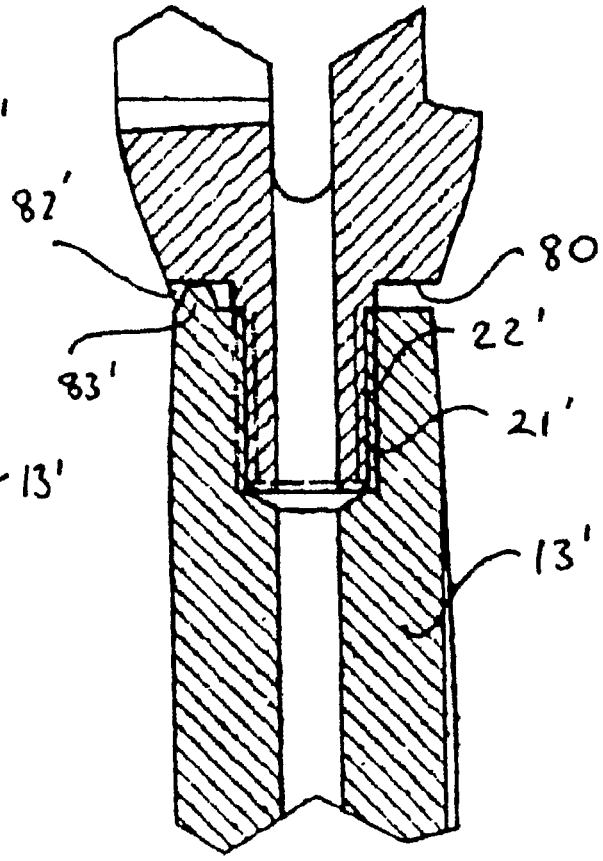
FIG. 8B is a cross-sectional view of the drilling tool in FIG. 8A.

In an alternative embodiment, as illustrated in FIGS. 8A and 8B, the drilling tool comprises first and second ends (the latter not shown), a shaft 13' extending between the ends. The first end having a drill bit 15' to penetrate rock. The drill bit 15' and the shaft 13' have complementary threads 22' and 21', respectively. A shoulder surface 80' of the drill bit and an end of the shaft comprise a relative rotation stop that ensures that the drill bit remains loose during drilling in a first direction. Here the term "loose" means that the uncoupling torque is not more than 10% of the coupling torque, i.e. there is no need for a wrench or hammer to disassemble the drilling tool, only the use of hand power.

One of the drill bit and the shaft is provided with a projection 83' and the other with a recess 81'. The projection and an upstanding wall 82' of the recess 81' abut to stop relative rotation of the drill bit and the shaft. The threads 21' and 22' are matched such that the projection 83' will enter into the recess 81' to provide a minimum gap between the shoulder surface 80' of the drill bit and the end of the shaft 13'. The projection and the recess have been described more closely above in connection with the previous embodiment.

Figure 10:
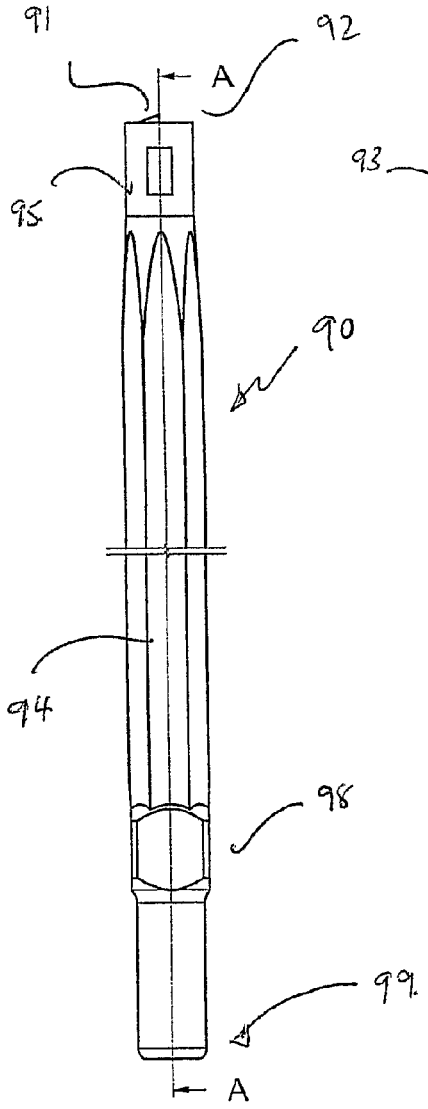
FIG. 10 is a side view of a drill shaft for further alternative drilling tool.
Figure 11:
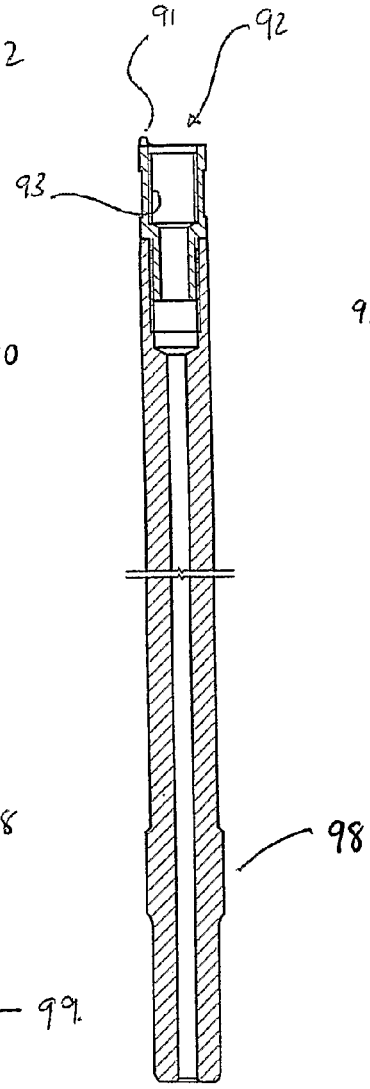
FIG. 11 is a cross-sectional view of the drill shaft of FIG. 10.
Figure 12:
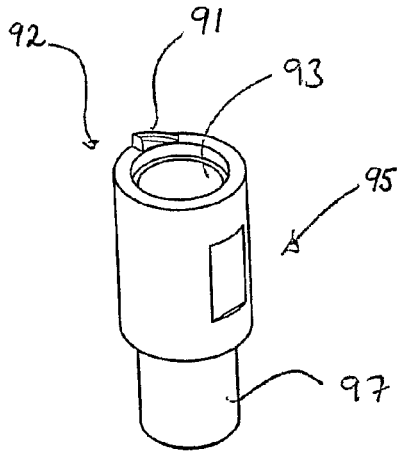
FIG. 12 is perspective view of an end coupling of the drill shaft of FIG. 10.

An alternative shaft 90 to the shaft 13' for the drilling tool of FIGS. 8A and 8B is illustrated in FIGS. 10 to 12. As in the earlier embodiment, the shaft 90 includes a projection 91 on a first end 92 and incorporates an internal thread 93 which is arranged to receive the threaded shank of the drill bit 15'. In this way, a drilling tool incorporating the shank 90 is able to function in the same way as the drilling tool shown in FIGS. 8A and 8B.

However in contrast to the shaft 13' which is made as an integral element, the shaft 90 includes a major portion 94 and an end portion 95. These portions 94 and 95 are axially aligned with the end portion 95 incorporating the threaded coupling 93 to receive the drill bit and the projection 91 on its distal end.

In the illustrated form, the main portion 94 is a conventional drill rod and includes a drive element 98 formed adjacent the second end 99 which is arranged to be connected a drilling apparatus to provide rotation and thrust to the drilling tool. The end portion 95 is in the form of an end coupling incorporates a threaded shank 96 (as best seen in FIG. 12) arranged to screw into a threaded bore 97 provided on the end of the drill rod 94. This threaded bore 97 is provided to accommodate a drill bit in a conventional drill rod configuration. In this way, the end coupling 95 which is typically formed as a cast component provides a simple arrangement to convert a conventional drill rod into one that can incorporate the stop mechanism as described above. In particular the end coupling 95 can be retro-fitted without requiring any modification to the drill rod 94.

In the claims which follow and in the preceding description of relative rotation stop means where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The disclosures in Australian patent application Nos. 2006236010 and 2006236012, from which this application claims priority, are incorporated herein by reference.

Variations and/or modifications may be made to the parts previously described without departing from the spirit or ambit of the invention.

The invention claimed is:

1. A drilling tool comprising first and second ends, a shaft extending between the ends, the first end having a drill bit to penetrate rock, the drill bit and the shaft having complementary threads, and a stop that limits rotation of the drill bit on the shaft to maintain the drill bit in loose threaded connection with the shaft during drilling in a first direction, wherein the stop comprises cooperating abutment surfaces, one said surface disposed on the drill bit and the other said surface disposed on the shaft, wherein one of the drill bit and the shaft is provided with a projection and the other one of the drill bit and the shaft with a recess, said projection and said recess having respective ones of said abutment surfaces that provide said stop, and wherein the stop limits the drill bit from rotating on the shaft so as to maintain a gap between an end surface of the shaft and an end surface of the drill bit during drilling.

2. A drilling tool according to claim 1, wherein the shaft comprises a main portion and an end portion, the main and end portions being interconnected and axially aligned and wherein the end portion receives the drill bit and incorporates one of said co-operating abutment surfaces.

3. A drilling tool according to claim 2, wherein the main and end portions have complementary threads and are interconnected by a threaded shank on the end portion being in threaded engagement with a threaded bore disposed in said main portion.

4. A drilling tool according to claim 2, wherein the main portion comprises a drill rod.

5. A drilling tool according to claim 1, wherein the shaft includes an internal passage to allow for fluid to be passed between the ends of the drilling tool.

6. A self drilling rock bolt comprising first and second ends, a shaft extending between the ends, and an anchoring device extending along a first part of the shaft adjacent the first end, the anchoring device having an internal thread that cooperates with an external thread on the shaft, the first end having a drill bit to penetrate rock during drilling in a first direction and a stop to limit the rotation of the anchoring device on the shaft to maintain the anchoring device in loose threaded connection on the shaft during drilling, wherein the stop limits the anchoring device from rotating on the shaft so as to maintain a gap between an end surface of the anchoring device and an end surface of the drill bit during drilling.

7. The self drilling rock bolt according to claim 6, wherein the stop comprises co-operating abutment surfaces, one said surface disposed on the drill bit and the other said surface disposed on the anchoring device.

8. The self drilling rock bolt according to claim 7, wherein the second end is adapted to be connected to a drilling apparatus to allow rotation of, and thrust to, the bolt, and the anchoring device comprising a mandrel, the mandrel being mounted to and cooperating with the external thread on the shaft and at least one expansion element overlaying the mandrel, wherein the at least one expansion element is operative to be displaced radially outwardly on rotation of the mandrel on the shaft in a direction that causes movement of the mandrel relative to the expansion element towards the second end, said rotation of the mandrel being arranged to occur on rotation of the shaft in a second direction opposite to said first direction.

9. The self drilling rock bolt according to claim 8, wherein one of said cooperating abutment surfaces of said stop is provided on said mandrel.

10. The self drilling rock bolt according to claim 8, wherein the at least one expansion element is joined to a connector forming an anchor assembly that is arranged to be captured between an end surface of the drill bit and an end surface of the shaft.

11. The self drilling rock bolt according to claim 10, wherein one of said cooperating abutment surfaces of said stop is provided on said connector, the stop being arranged to adopt a disengaged condition when the connector is disposed on said shaft end surface so that said stop does not prevent rotation of the anchoring device on the shaft and an engaged condition where the connector is spaced from the shaft end surface and where the stop prevents the anchor assembly from rotating about the shaft thereby preventing the mandrel from moving axially towards the drill bit during drilling in said first direction.

12. The self drilling rock bolt according to claim 11, wherein the stop is caused to move from the disengaged condition to the engaged condition on movement of the mandrel into a predetermined position under rotation of the mandrel about the shaft in a direction that induces axial movement of the mandrel towards said drill bit.

13. The self drilling rock bolt according to claim 11, wherein the stop is caused to move from the engaged condition to the disengaged condition on the movement of the mandrel from the predetermined position under the rotation of the mandrel about the shaft in a direction that induces axial movement of the mandrel towards said second end.

14. The self drilling rock bolt according to claim 7, wherein one of the drill bit and the anchoring device is provided with a projection and the other one of the drill bit and the anchoring device with a recessed surface, said projection and said recessed surface having respective ones of said abutment surfaces that provide said stop.

15. The self drilling rock bolt according to claim 14, wherein the recessed surface is inclined at an acute angle relative to a shoulder surface of the drill bit or anchoring device in which the recessed surface is formed.

16. The self drilling rock bolt according to claim 15, wherein the magnitude of the acute angle is at least 20% greater than a pitch angle of said external thread formed on said shaft.

17. The self drilling rock bolt according to claim 14, wherein the projection has a maximum height that is less than the largest depth of the recessed surface.

18. An anchoring device for a self drilling rock bolt for retaining the bolt when located in a drilled hole comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, said anchor assembly being keyed to the mandrel, and said anchor assembly comprising part of a stop, said stop provided to stop the anchor assembly from rotating about an axis of the rock bolt shaft and prevent the mandrel from moving axially in one direction along the bolt shaft during drilling in a first direction, wherein the connector includes a body section and at least one connecting leg, said at least one connecting leg carrying a tag.

19. The anchoring device according to claim 18, further comprises a projection provided on the connector, said projection forming part of said stop.

20. The anchoring device according to claim 19, wherein the projection comprises an abutment surface.

21. The anchoring device according to claim 18, wherein the connector includes a body section and at least one connecting leg, said at least one connecting leg carrying a tag.

22. The anchoring device according to claim 18, wherein the tag that is provided adjacent to an end of the leg and is integrated with the connector, said tag being adapted to be passive during drilling and active during anchoring of the anchoring device to inhibit rotation of the anchoring device in a bore hole on rotation of the rock bolt.

23. A self drilling rock bolt comprising first and second ends, a shaft extending between the ends, and an anchoring device extending along a first part of the shaft adjacent the first end, the anchoring device having an internal thread that cooperates with an external thread on the shaft, the first end having a drill bit to penetrate rock during drilling in a first direction and a stop to limit the rotation of the anchoring device on the shaft to maintain the anchoring device in loose threaded connection on the shaft during drilling, wherein the stop comprises co-operating abutment surfaces, one said surface disposed on the drill bit and the other said surface disposed on the anchoring device, one of the drill bit and the anchoring device is provided with a projection and the other one of the drill bit and the anchoring device with a recessed surface, said projection and said recessed surface having respective ones of said abutment surfaces that provide said stop, and the projection has a maximum height that is less than the largest depth of the recessed surface.

* * * * *